US007421758B2

(12) United States Patent
Kim et al.

(10) Patent No.: US 7,421,758 B2
(45) Date of Patent: Sep. 9, 2008

(54) UPRIGHT VACUUM CLEANER WITH SWING BRUSH

(75) Inventors: Sang-young Kim, Gwangmyeong-si (KR); Jun-young Lim, Incheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/296,304

(22) Filed: Dec. 8, 2005

(65) Prior Publication Data

US 2006/0156505 A1 Jul. 20, 2006

(30) Foreign Application Priority Data

Jan. 20, 2005 (KR) ..... 10-2005-0005490

(51) Int. Cl.
*A47L 5/00* (2006.01)

(52) U.S. Cl. ..... 15/319; 15/339; 15/340.2; 15/340.3; 15/381

(58) Field of Classification Search ..... None
See application file for complete search history.

(56) References Cited

U.S. PATENT DOCUMENTS 1,197,915 A * 9/1916 Dance ..... 15/364
4,430,768 A * 2/1984 Novinger ..... 15/381
6,061,869 A * 5/2000 Ettes et al. ..... 15/340.2
2005/0262660 A1 * 12/2005 Yoo et al. ..... 15/381
2007/0000085 A1 * 1/2007 Cipolla et al. ..... 15/340.2

* cited by examiner

*Primary Examiner*—David A Redding
(74) *Attorney, Agent, or Firm*—Greenblum & Bernstein, P.L.C.

(57) ABSTRACT

Disclosed herein is an upright vacuum cleaner with a swing brush. The upright vacuum cleaner comprises an upright cleaner body having a suction nozzle, a drive unit mounted in the cleaner body for moving the cleaner body forward or rearward, a grip unit slidably mounted to the upper end of the cleaner body, the grip unit having a sensor for sensing a sliding direction of the grip unit, a control unit for controlling the drive unit to be operated, such that the cleaner body is moved forward or rearward, based on information sensed by the sensor, a movement converting unit for converting a rotating movement of the drive unit to an angular reciprocating movement, and a swing brush connected to the movement converting unit for performing the angular reciprocating movement. The swing brush is mounted in a suction nozzle of the cleaner body while being in contact with the floor.

20 Claims, 6 Drawing Sheets

UPRIGHT VACUUM CLEANER WITH SWING BRUSH

BACKGROUND OF THE INVENTION

1. Field of the Invention

The present invention relates to an upright vacuum cleaner, and, more particularly, to an upright vacuum cleaner that is capable of simultaneously performing movement of a cleaner body and swing of a brush with a single DC motor.

2. Description of the Related Art

FIG. 1 is a perspective view illustrating a conventional upright vacuum cleaner. As shown in FIG. 1, the conventional upright vacuum cleaner comprises: a cleaner body 100 for suctioning air though a suction nozzle 101 and filtering the air to remove foreign matter from the air; a drive motor 200 mounted in the cleaner body 100 for driving the vacuum cleaner such that the cleaner body 100 can be moved forward or rearward; and a grip unit 300 mounted to the upper end of the cleaner body 100. At the grip unit 300 is disposed a manipulation lever for controlling the forward or rearward movement direction of the vacuum cleaner.

As shown in FIGS. 1 and 2, the conventional upright vacuum cleaner further comprises: a frictional clutch 400 for converting a rotating force of the drive motor 200 transmitted to a left clutch gear 401 or a right clutch gear 402 via a wire 301 connected between the manipulation lever of the grip unit 300 and the frictional clutch 400 to a forward or reverse rotation; and a pair of drive wheels 500 rotated in the forward or reverse direction by the rotating force transmitted by the left clutch gear 401 or the right clutch gear 402.

The manipulation lever is disposed at the grip unit 300 for converting operation of the vacuum cleaner to a neutral operation, a forward-movement operation, or a rearward-movement operation. When the manipulation lever is lowered, a swing lever is pushed by the wire. As a result, a felt disc of the frictional clutch comes into tight contact with a friction disc of the left clutch gear. Consequently, the vacuum cleaner is moved forward. When the manipulation lever is raised, the swing lever is pulled by the wire. As a result, the felt disc of the frictional clutch comes into tight contact with a friction disc of the right clutch gear. Consequently, the vacuum cleaner is moved rearward. When the manipulation lever is placed at the neutral position, the felt disc of the frictional clutch comes into tight contact with neither the friction disc of the left clutch gear nor the friction disc of the right clutch gear. Consequently, the vacuum cleaner is not moved.

In the conventional upright vacuum cleaner with the above-stated construction, however, the manipulation lever is manually operated to move the vacuum cleaner forward or rearward. Specifically, the manipulation lever is manually operated whenever the grip unit of the vacuum cleaner is pushed or pulled to perform a cleaning operation. At this time, a relatively large force must be applied to the manipulation lever to push or pull the wire.

Furthermore, the structure of the frictional clutch and the clutch gears is very complicated, and therefore, the size of the cleaner body is increased, and the manufacturing costs of the cleaner body are increased.

SUMMARY OF THE INVENTION

Therefore, the present invention has been made in view of the above problems, and it is an object of the present invention to provide an upright vacuum cleaner that is capable of simultaneously performing movement of a cleaner body and swing of a brush with a single DC motor.

It is another object of the present invention to provide an upright vacuum cleaner that is capable of controlling the forward or reverse rotation of a drive motor based on a signal sensed by a sensor unit, thereby reducing the number of mechanical linkages for power transmission, and therefore, decreasing the size of the vacuum cleaner and reducing the manufacturing costs of the vacuum cleaner.

In accordance with the present invention, the above and other objects can be accomplished by the provision of an upright vacuum cleaner with a swing brush, comprising: a drive unit; a grip unit having a sensor for sensing a sliding direction; a control unit for controlling a rotating direction of the drive unit based on the sliding direction sensed by the sensor; and a movement converting unit for converting a rotating movement of the drive unit to an angular reciprocating movement.

Preferably, the drive unit comprises: a drive motor; a drive shaft extending outward from the drive motor at opposite sides of the drive motor, the drive shaft being rotated by the drive motor; and drive wheels connected to opposite ends of the drive shaft, respectively, and the drive motor is a DC motor that is rotatable in alternating directions.

Preferably, the grip unit is slid when a pushing or pulling force is applied to the grip unit, and a neutral state, a forward movement, or a rearward movement of the grip unit is sensed by the sensor when the grip unit is slid.

Preferably, the control unit controls the drive motor to be rotated in the forward or reverse direction based on the forward or rearward sliding direction sensed by the sensor.

Preferably, the movement converting unit comprises: a belt wound around one end of the drive unit; a cam shaft rotatably mounted in a cleaner body such that the belt is wound around the cam shaft; a cam pin eccentrically formed at the outside surface of the cam shaft; a link having one end hingedly connected to the cam pin; an angular moving pin to which the other end of the link is hingedly connected; and an angular rotating shaft inserted through the swing brush, the angular moving pin being formed at the outside surface of the angular rotating shaft.

Preferably, the movement converting unit comprises: a cam shaft rotatable by the drive unit; a cam pin eccentrically formed at the outside surface of the cam shaft; a link having one end hingedly connected to the cam pin; an angular moving pin to which the other end of the link is hingedly connected; and an angular rotating shaft having an outside surface at which the angular moving pin is formed.

Preferably, the diameter of the camp shaft is less than that of the angular rotating shaft, and the angular moving pin is formed at the upper end of the outside surface of the angular rotating shaft.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
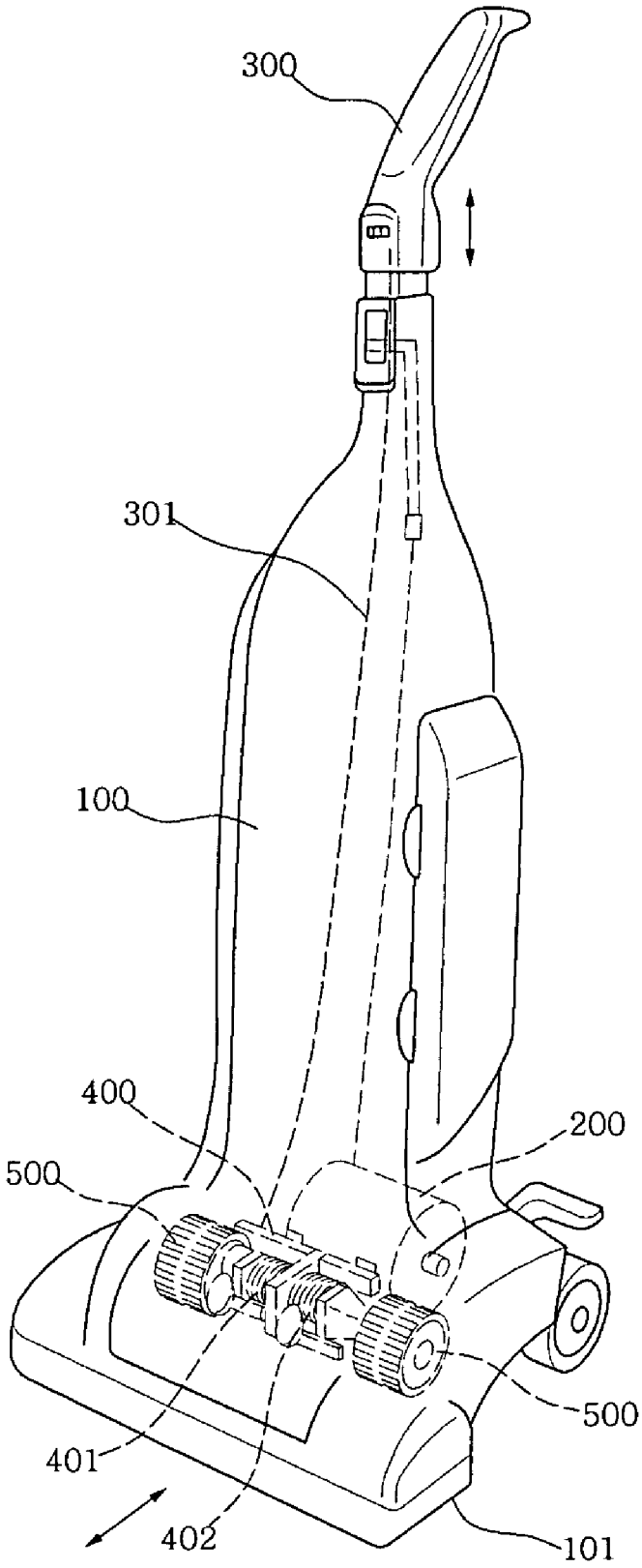
FIG. 1 is a perspective view illustrating a conventional upright vacuum cleaner.
Figure 2:
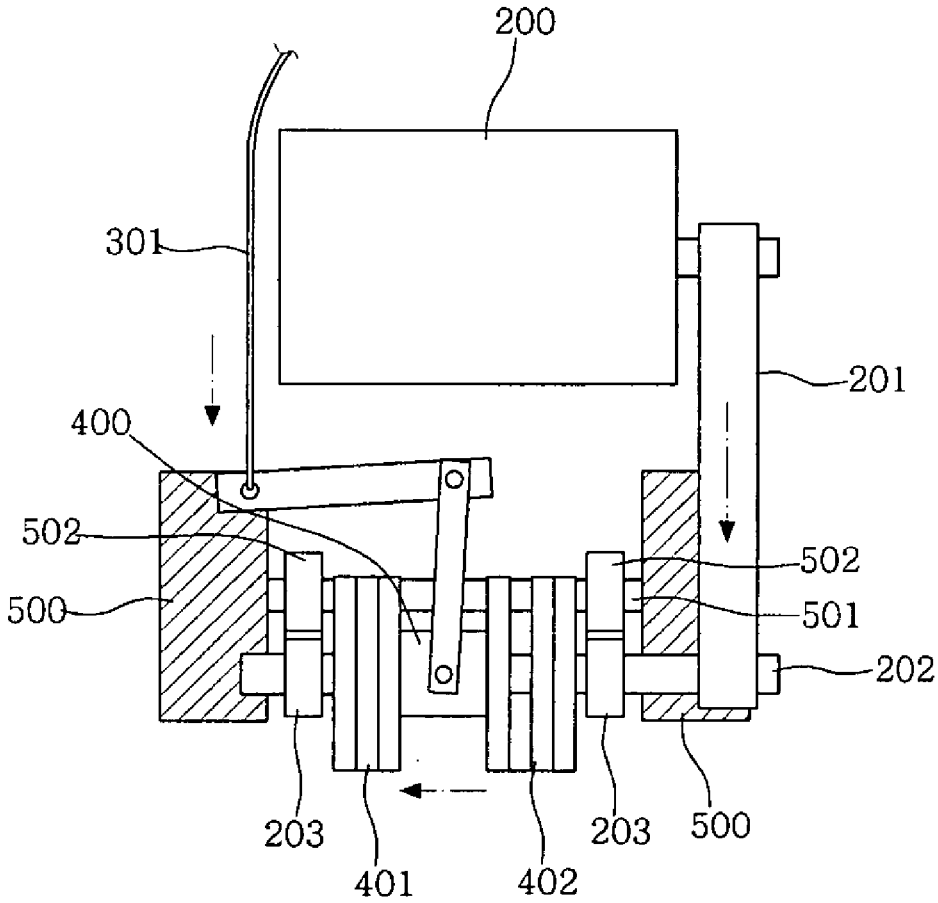
FIG. 2 is a plan view, in section, illustrating the principal part of the conventional upright vacuum cleaner shown in FIG. 1.
Figure 3:
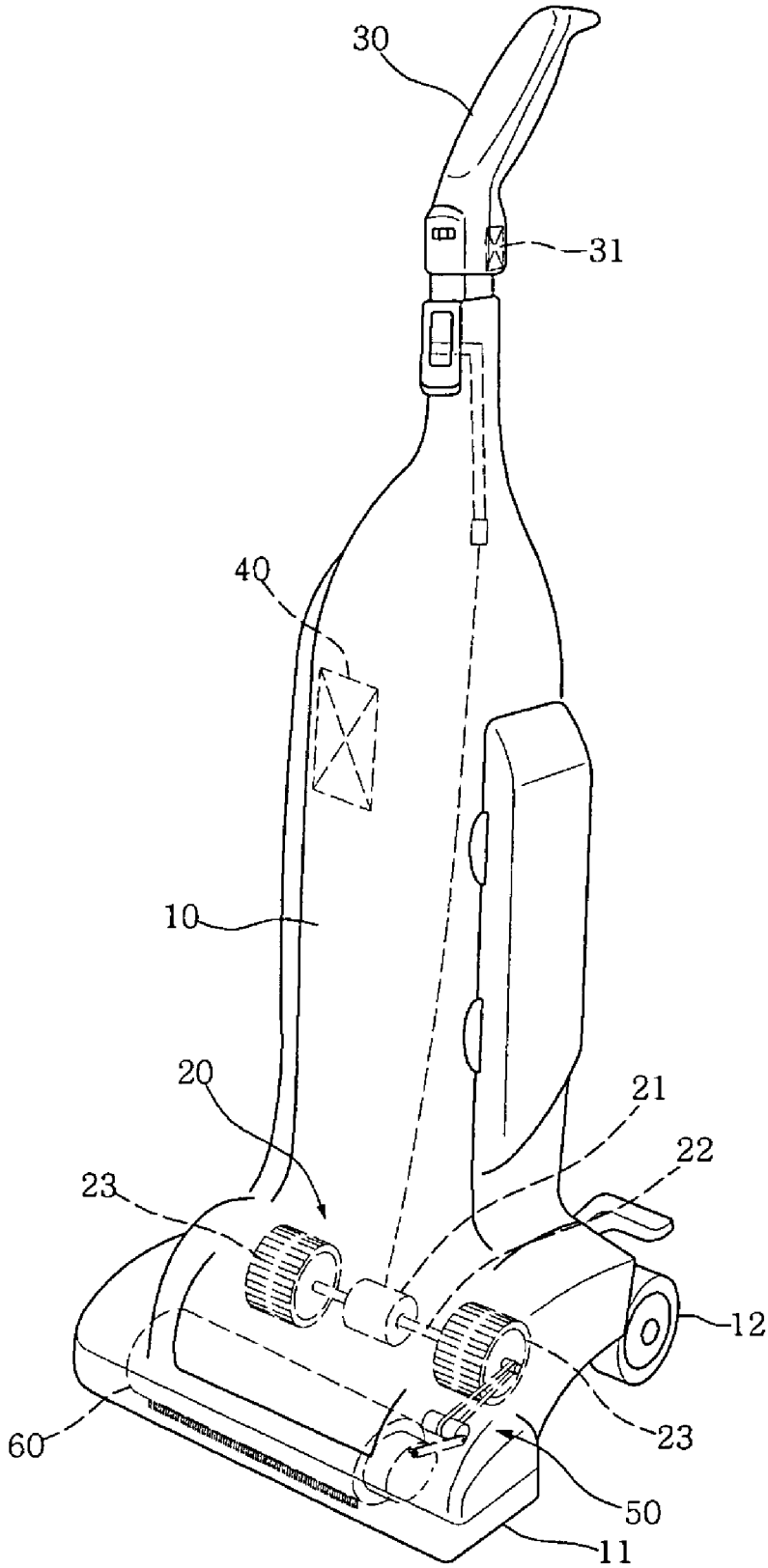
FIG. 3 is a perspective view illustrating an upright vacuum cleaner according to a preferred embodiment of the present invention.
Figure 4:
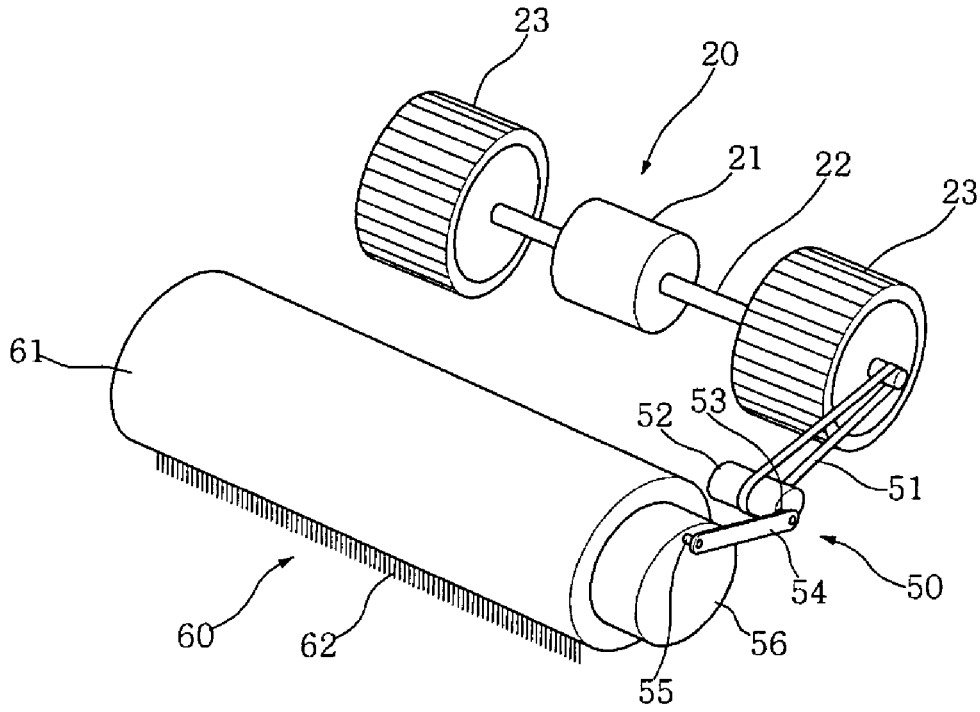
FIG. 4 is an enlarged perspective view illustrating the principal part of the upright vacuum cleaner according to the present invention shown in FIG. 3.

FIG. 3 is a perspective view illustrating an upright vacuum cleaner according to a preferred embodiment of the present invention, and FIG. 4 is an enlarged perspective view illustrating the principal part of the upright vacuum cleaner according to the present invention shown in FIG. 3.

As shown in FIGS. 3 and 4, the upright vacuum cleaner comprises: a cleaner body 10 having a suction nozzle 11; a drive unit 20 for moving the cleaner body 10 forward or rearward; a grip unit 30 slidably mounted to the upper end of the cleaner body 10, the grip unit 30 having a sensor 31; a control unit 40 for controlling the rotating direction of the drive unit 20 based on information sensed by the sensor 31; a movement converting unit 50 for converting a rotating movement of the drive unit 20 to an angular reciprocating movement; and a swing brush 60 connected to the movement converting unit 50 for performing the angular reciprocating movement.

The cleaner body 10 is formed in the shape of an upright member. The suction nozzle 11 is disposed at the lower surface of the lower end of the cleaner body 10. At the rear of the lower end of the cleaner body 10 are mounted auxiliary wheels 12.

The cleaner body 10 serves to suction foreign matter on a floor along with air through the suction nozzle 11 and filter the air such that the foreign matter is removed from the air. The cleaner body 10 is moved forward or rearward in an upright state by means of the drive wheels 23, which are rotated by the drive unit 20, and the auxiliary wheels 12.

The drive unit 20 comprises: a drive motor 21 mounted in the cleaner body 10; a drive shaft 22 extending outward from the drive motor 21 at opposite sides of the drive motor 21; and drive wheels 23 connected to opposite ends of the drive shaft 22, respectively.

When the drive motor 21 is driven under the control of the control unit 40, the drive shaft 22 is rotated in the forward or reverse direction. As a result, the drive wheels 23 are rotated in the forward or reverse direction, and therefore, the cleaner body 10, which is supported by the auxiliary wheels 12, is moved forward or rearward in an upright state.

The grip unit 30 is slidably mounted to the upper end of the cleaner body 10. When a pushing or pulling force is applied to the grip unit 30, the grip unit 30 is slid forward or rearward relative to the cleaner body 10.

When the grip unit 30 is slid forward or rearward by a user, the forward or rearward sliding movement of the grip unit 30 is sensed by the sensor 31 mounted in the grip unit 30. Based on the information sensed by the sensor 31, the control unit 40 transmits a control signal to the drive motor 21 such that the drive motor 21 is rotated in the forward or reverse direction, and therefore, the cleaner body 10 is moved forward or rearward.

Specifically, when the user pushes the grip unit 30 to move the vacuum cleaner forward, the grip unit 30 is slid forward from a neutral position, which is sensed by the sensor 31. The information sensed by the sensor 31 is input to the control unit 40. Based on the information input to the control unit 40, the control unit 40 supplies electric current to the drive motor 21 and controls the drive motor 21 to be rotated in the forward direction. Consequently, the cleaner body 10 is moved forward.

When the user pulls the grip unit 30 to move the vacuum cleaner rearward, on the other hand, the grip unit 30 is slid rearward from the neutral position, which is sensed by the sensor 31. The information sensed by the sensor 31 is input to the control unit 40. Based on the information input to the control unit 40, the control unit 40 supplies electric current to the drive motor 21 and controls the drive motor 21 to be rotated in the reverse direction. Consequently, the cleaner body 10 is moved rearward.

When no force is applied to the grip unit 30, the grip unit 30 is placed at the neutral position, which is sensed by the sensor 31. The information sensed by the sensor 31 is input to the control unit 40. Based on the information input to the control unit 40, the control unit 40 does not supply electric current to the drive motor 21. Consequently, the cleaner body 10 is not moved.

The movement converting unit 50 comprises: a belt 51 wound around the drive shaft 22 extending through one of the drive wheels 23; a cam shaft 52 rotatably mounted in the cleaner body 10 such that the belt 51 is wound around the cam shaft 52; a cam pin 53 eccentrically formed at the outside surface of the cam shaft 52; a link 54 having one end hingedly connected to the cam pin 53; and an angular rotating shaft 56 having an angular moving pin 55 formed at the upper part of the outside surface, to which the other end of the link 54 is hingedly connected, the angular rotating shaft 56 being attached to the swing brush 60.

The rotating movement of the drive shaft 22 is transmitted to the cam shaft 52 via the belt 51 such that the cam shaft 52 is rotated. As the cam shaft 52 is rotated, the cam pin 53 performs a circular movement, by which the link 54 performs a reciprocating movement. According to the reciprocating movement of the link 54, the angular moving pin 55 is angularly reciprocated. As a result, the angular rotating shaft 56 is angularly rotated in alternating directions, and therefore, the swing brush 60 attached to the angular rotating shaft 56 is angularly reciprocated. Consequently, a brush part formed at the swing brush 60 sweeps a floor, such as carpet, such that foreign matter is separated from the floor.

Preferably, the diameter of the camp shaft 52 is less than that of the angular rotating shaft 56 such that the rotating movement of the cam shaft 52 can be converted into the angular rotation of the angular rotating shaft 56 by the link 54.

The swing brush 60 comprises: a cylindrical brush body 61 attached to the angular rotating shaft 56; and a brush part 62 attached along the lower part of the outer circumferential surface of the brush body 61 in the longitudinal direction.

As the angular rotating shaft 56 is angularly rotated in alternating directions, the brush body 61 attached to the angular rotating shaft 56 is angularly reciprocated, and therefore, the brush part 62 is angularly reciprocated while being in contact with the floor. Consequently, the brush part 62 sweeps the floor such that foreign matter is separated from the floor. The separated foreign matter is suctioned together with air into the cleaner body 10 through the suction nozzle 11, and is then separated from the air.

The angular moving pin 55 is formed at the upper end of the outside surface of the angular rotating shaft 56. Consequently, the angular reciprocating movement of the swing brush 60 is more smoothly performed.

Figure 5:
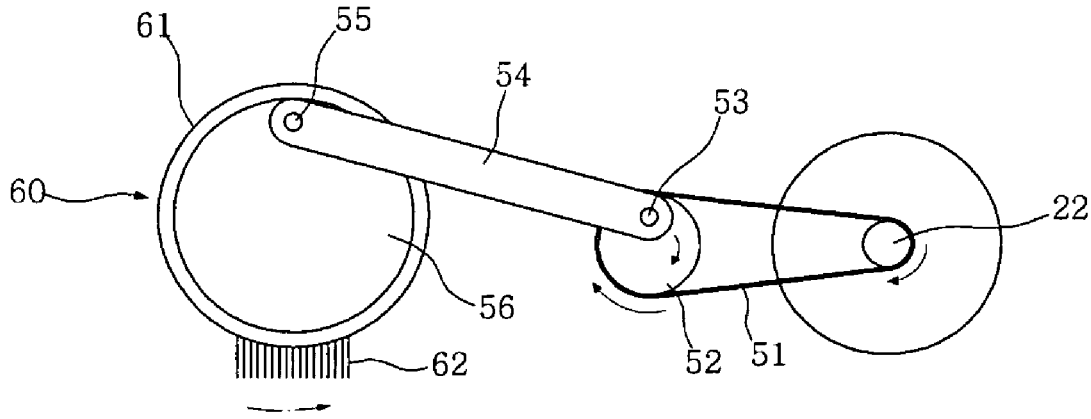
FIGS. 5 to 7 are side views illustrating operation of the upright vacuum cleaner according to the present invention.
Figure 6:
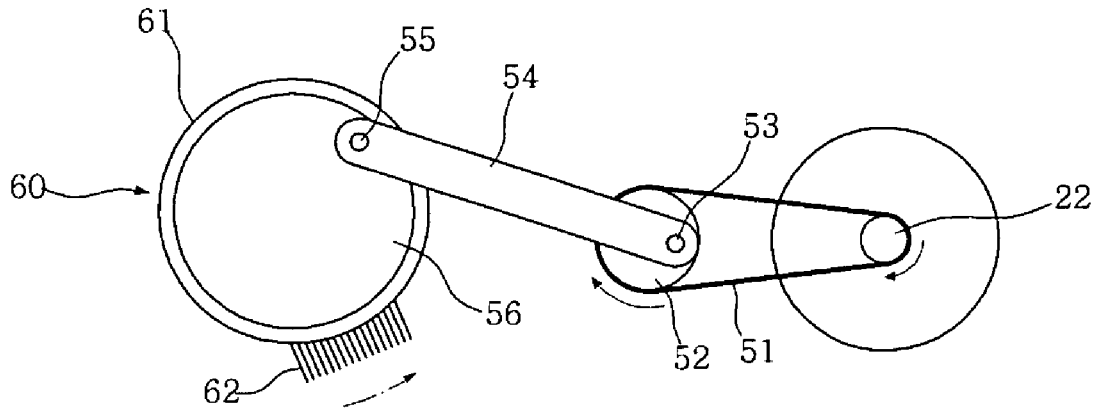
Figure 7:
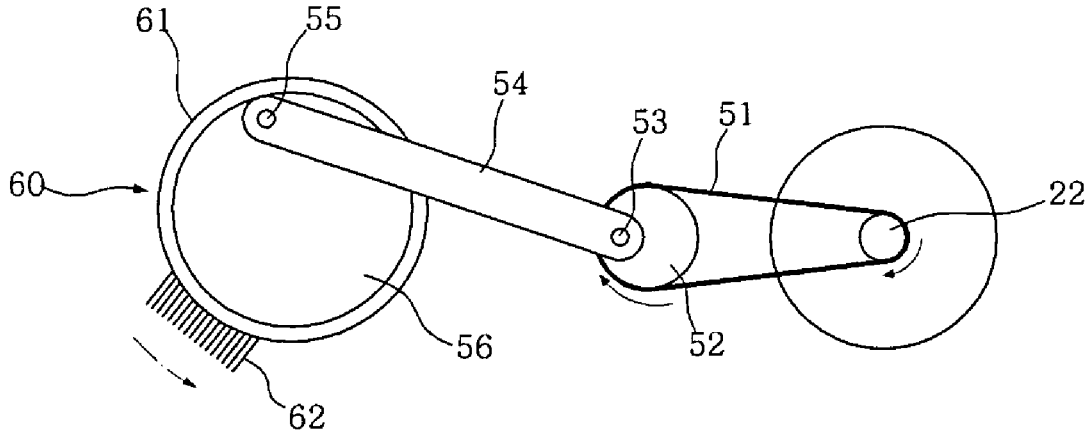

FIGS. 5 to 7 are side views illustrating operation of the upright vacuum cleaner according to the present invention.

When the drive shaft 22 is rotated in the forward direction, as shown in FIGS. 5 to 7, the cam shaft 52 is rotated by means of the belt 51. As the cam shaft 52 is rotated, the cam pin 53 performs a circular movement.

As the cam pin 53 performs the circular movement, the link 54 hingedly connected to the cam pin 53 performs a reciprocating movement, and therefore, the angular moving pin 55 hingedly connected to the end of the link 54 is angularly moved.

As the angular moving pin 55 is angularly reciprocated, the angular rotating shaft 56 is angularly rotated in alternating directions, and therefore, the brush part 62 attached to the lower part of the brush body 61 of the swing brush 60 is angularly reciprocated. Consequently, foreign matter is separated from the floor by the brush part 62 of the swing brush 60.

When the drive shaft 22 is rotated in the reverse direction, on the other hand, the brush part 62 is also angularly reciprocated by means of the cam shaft 52 and the link 54.

The brush part 62 is angularly reciprocated when the drive shaft 22 is rotated irrespective of the rotating direction of the drive shaft 22. Consequently, the swing brush 60 is swung not only when the upright vacuum cleaner is moved forward but also when the upright vacuum cleaner is moved rearward.

Figure 8:
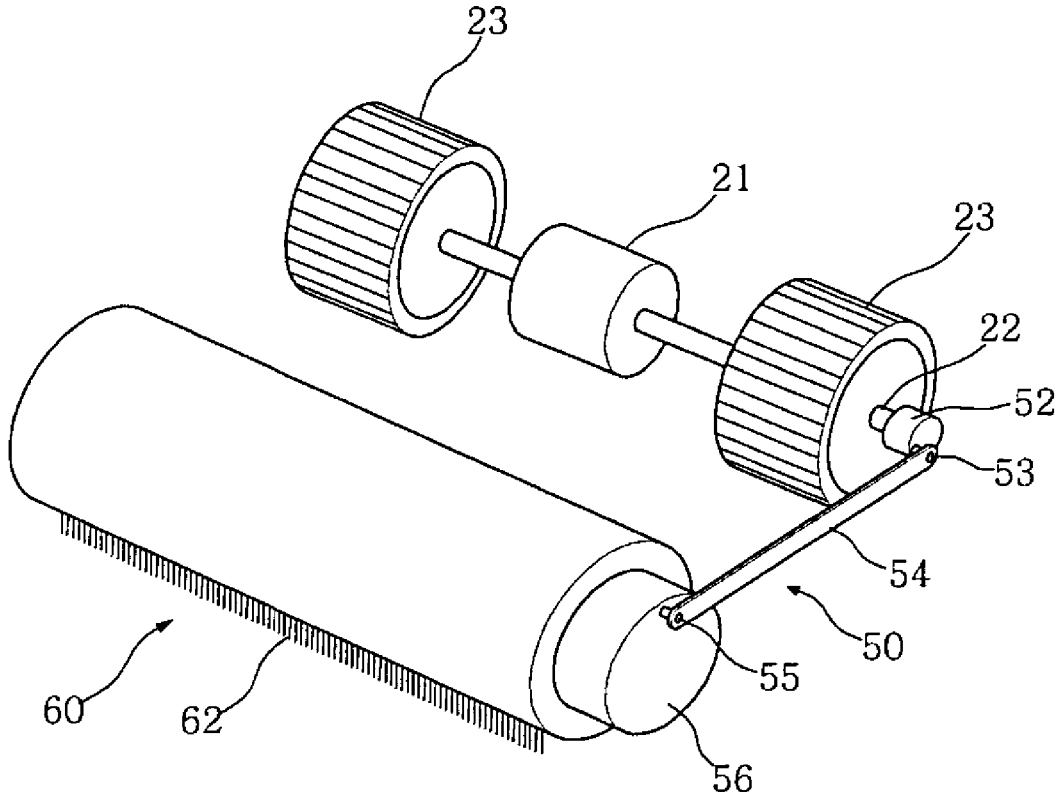
FIG. 8 is an enlarged perspective view illustrating the principal part of an upright vacuum cleaner according to another preferred embodiment of the present invention.

FIG. 8 is an enlarged perspective view illustrating the principal part of an upright vacuum cleaner according to another preferred embodiment of the present invention.

As shown in FIG. 8, the upright vacuum cleaner is characterized by a movement converting unit 50 comprising: a cam shaft 52 attached to the drive shaft 22 extending through one of the drive wheels 23; a cam pin 53 eccentrically formed at the outside surface of the cam shaft 52; a link 54 having one end hingedly connected to the cam pin 53; an angular moving pin 55 to which the other end of the link 54 is hingedly connected; and an angular rotating shaft 56 inserted through the swing brush 60, the angular moving pin 55 being formed at the upper part of the outside surface of the angular rotating shaft 56.

When the drive shaft 22 is rotated by the drive motor 21, the cam shaft 52 attached to the drive shaft 22 is rotated. As a result, the cam pin 53 eccentrically formed at the outside surface of the cam shaft 52 performs a circular movement, by which the link 54 performs a reciprocating movement. According to the reciprocating movement of the link 54, the angular moving pin 55 is angularly reciprocated, and therefore, the angular rotating shaft 56 is angularly rotated in alternating directions.

As the angular rotating shaft 56 is angularly rotated in alternating directions, the brush part 62 of the swing brush 60 is angularly reciprocated. Consequently, foreign matter is separated from the floor by the brush part 62 of the swing brush 60.

As described above, the cam shaft 52 is directly connected to the drive shaft 22. Consequently, the rotating force of the drive shaft 22 is transmitted to the cam shaft 52 while the upright vacuum cleaner is moved forward or rearward by means of the drive wheels 23, which are rotated as the drive shaft 22 is rotated by the drive motor 21.

Furthermore, the angular moving pin 55 is formed at the upper end of the outside surface of the angular rotating shaft 56. Consequently, the angular reciprocating movement of the swing brush 60 is more smoothly performed.

As apparent from the above description, the present invention provides an upright vacuum cleaner that is capable of simultaneously performing movement of a cleaner body and swing of a brush with a single DC motor.

Furthermore, the present invention provides an upright vacuum cleaner that is capable of controlling the forward or reverse rotation of a drive motor based on a signal sensed by a sensor unit, thereby reducing the number of mechanical linkages for power transmission, and therefore, decreasing the size of the vacuum cleaner and reducing the manufacturing costs of the vacuum cleaner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An upright vacuum cleaner with a swing brush, comprising:

a drive unit;

a grip unit having a sensor that senses a sliding direction;

a control unit that controls a rotating direction of the drive unit based on the sliding direction sensed by the sensor; and a movement converting unit that converts a rotating movement of the drive unit to an angular reciprocating movement, the movement converting unit being eccentrically connected to a cam shaft, which is connected to a swing brush via a link, to convert the rotating movement of the drive unit to the angular reciprocating movement, wherein the movement converting unit comprises:

a belt wound around one end of the drive unit;

the cam shaft being rotatably mounted in a cleaner body such that the belt is wound around the cam shaft;

a cam pin eccentrically formed at the outside surface of the cam shaft;

a link having one end hingedly connected to the cam pin;

an angular moving pin to which the other end of the link is hingedly connected; and an angular rotating shaft inserted through the swing brush, the angular moving pin being formed at the outside surface of the angular rotating shaft.

2. The cleaner as set forth in claim 1, wherein the drive unit comprises:

a drive motor;

a drive shaft extending outward from the drive motor at opposite sides of the drive motor, the drive shaft being rotated by the drive motor; and drive wheels connected to opposite ends of the drive shaft, respectively.

3. The cleaner as set forth in claim 2, wherein the drive motor is a DC motor that is rotatable in alternating directions.

4. The cleaner as set forth in claim 3, wherein the grip unit is slid when a pushing or pulling force is applied to the grip unit.

5. The cleaner as set forth in claim 4, wherein a neutral state, a forward movement, or a rearward movement of the grip unit is sensed by the sensor when the grip unit is slid.

6. The cleaner as set forth in claim 1, wherein the control unit controls the drive motor to be rotated in the forward or reverse direction based on the forward or rearward sliding direction sensed by the sensor.

7. The cleaner as set forth in claim 1, wherein the diameter of the cam shaft is less than that of the angular rotating shaft.

8. The cleaner as set forth in claim 1, wherein the angular moving pin is formed at the upper end of the outside surface of the angular rotating shaft.

9. The cleaner as set forth in claim 1, wherein the swing brush comprises:

a cylindrical brush body disposed on the outer circumferential surface of the angular rotating shaft; and a brush part attached along the lower part of the outer circumferential surface of the brush body in the longitudinal direction.

10. An upright vacuum cleaner with a swing brush, comprising:

a drive unit;

a grip unit having a sensor that senses a sliding direction;

a control unit that controls a rotating direction of the drive unit based on the sliding direction sensed by the sensor; and a movement converting unit eccentrically connected to a cam shaft attached to one end of the drive unit and a swing brush that converts the rotating movement of the drive unit to the angular reciprocating movement, wherein the movement converting unit comprises:

the cam shaft rotatable by the drive unit;

a cam pin eccentrically formed at the outside surface of the cam shaft;

a link having one end hingedly connected to the cam pin;

an angular moving pin to which the other end of the link is hingedly connected; and an angular rotating shaft having an outside surface at which the angular moving pin is formed.

11. The cleaner as set forth in claim 10, wherein the drive unit comprises:

a drive motor;

a drive shaft extending outward from the drive motor at opposite sides of the drive motor, the drive shaft being rotated in the forward or reverse direction by the drive motor; and drive wheels connected to opposite ends of the drive shaft, respectively.

12. The cleaner as set forth in claim 10, wherein the grip unit is slid when a pushing or pulling force is applied to the grip unit.

13. The cleaner as set forth in claim 12, wherein a neutral state, a forward movement, or a rearward movement of the grip unit is sensed by the sensor when the grip unit is slid.

14. The cleaner as set forth in claim 10, wherein the control unit controls the drive motor to be rotated in the forward or reverse direction based on the forward or rearward sliding direction sensed by the sensor.

15. The cleaner as set forth in claim 10, wherein the diameter of the cam shaft is less than that of the angular rotating shaft.

16. The cleaner as set forth in claim 10, wherein the angular moving pin is formed at the upper end of the outside surface of the angular rotating shaft.

17. The cleaner as set forth in claim 10, wherein the swing brush comprises:

a cylindrical brush body disposed on the outer circumferential surface of the angular rotating shaft; and a brush part attached along the lower part of the outer circumferential surface of the brush body in the longitudinal direction.

18. An upright vacuum cleaner with a swing brush, comprising:

a drive unit including a drive motor, a drive shaft extending outward from the drive motor at opposite sides of the drive motor, the drive shaft being rotatable in the forward or reverse directions by the drive motor, and drive wheels connected to opposite ends of the drive shaft, respectively;

a grip unit having a sensor that senses a sliding direction;

a control unit that controls a rotating direction of the drive unit based on the sliding direction sensed by the sensor; and a movement converting unit eccentrically connected to a cam shaft attached to one end of the drive unit and a swing brush that converts the rotating movement of the drive unit to the angular reciprocating movement.

19. The cleaner as set forth in claim 18, wherein a neutral state, a forward movement, or a rearward movement of the grip unit is sensed by the sensor when the grip unit is slid.

20. The cleaner as set forth in claim 18, wherein the control unit controls the drive motor to be rotated in the forward or reverse direction based on the forward or rearward sliding direction sensed by the sensor.

* * * * *